US008376714B2

(12) United States Patent
Park

(10) Patent No.: US 8,376,714 B2
(45) Date of Patent: Feb. 19, 2013

(54) VARIABLE WATER PUMP CONTROL SYSTEM AND THE CONTROL METHOD THEREOF

(75) Inventor: Dong Won Park, Hwasung-si (KR)

(73) Assignees: Hyundai Motors Company, Seoul (KR); Kia Motors Corporation, Seoul (KR)

( * ) Notice: Subject to any disclaimer, the term of this patent is extended or adjusted under 35 U.S.C. 154(b) by 247 days.

(21) Appl. No.: 12/877,326

(22) Filed: Sep. 8, 2010

(65) Prior Publication Data

US 2011/0135508 A1 Jun. 9, 2011

(30) Foreign Application Priority Data

Dec. 4, 2009 (KR) ..... 10-2009-0120122

(51) Int. Cl.
*F04B 49/06* (2006.01)

(52) U.S. Cl. ..... 417/18; 417/22; 417/223; 123/41.01

(58) Field of Classification Search ..... 417/14, 417/18, 22, 223; 123/41.01
See application file for complete search history.

(56) References Cited

U.S. PATENT DOCUMENTS 7,908,877 B2 * 3/2011 Carlson et al. ..... 62/157
2008/0056911 A1 * 3/2008 Hanke et al. ..... 417/22

* cited by examiner

*Primary Examiner* — Charles Freay
*Assistant Examiner* — Patrick Hamo
(74) *Attorney, Agent, or Firm* — Morgan, Lewis & Bockius LLP

(57) ABSTRACT

A variable water pump control apparatus, may include a detecting portion detecting engine speed, operation of an idle stop and go system (ISG), coolant temperature, operation of a blower, and outside temperature, a variable water pump selectively circulating a coolant through an engine, and a control portion controlling the variable water pump according to the detected information including operating conditions and outside environmental factors, and a variable water pump control method may include detecting a driving condition and an environmental condition of a vehicle, and engaging or releasing a clutch of a variable water pump according to a detected condition so as to selectively circulate a coolant.

28 Claims, 2 Drawing Sheets

VARIABLE WATER PUMP CONTROL SYSTEM AND THE CONTROL METHOD THEREOF

CROSS-REFERENCE TO RELATED APPLICATION

The present application claims priority to Korean Patent Application No. 10-2009-0120122 filed in the Korean Intellectual Property Office on Dec. 4, 2009, the entire contents of which is incorporated herein for all purposes by this reference.

BACKGROUND OF THE INVENTION

1. Field of the Invention

The present invention relates to a variable water pump control system and a control method thereof. More particularly, the present invention relates to a variable water pump control system actively controlling a variable water pump and a control method thereof.

2. Description of Related Art

Vehicle manufacturers are currently attempting to improve fuel efficiency as well as exhaust gas quality through research processes thereof, and they have specifically increased a catalyst amount of the exhaust system or the capacity of the EGR cooler so as to satisfy emission regulations.

A coolant passage is formed between a cylinder block and a cylinder head of an engine, and a water pump circulates a coolant through the coolant passage so as to prevent overheating of the engine and sustain a regular temperature.

A conventional water pump is continuously operated to circulate the coolant regardless of a warmed up condition or a cold condition of the engine.

Accordingly, if the engine is started in a cold condition, the warming up time is delayed by the circulation of the coolant.

Also, since combustion efficiency is lower in a cold state of the engine, fuel mileage is lower, and the temperature of the exhaust gas is slowly raised, a light off time of a catalyst is delayed, and a harmful material of the exhaust gas is exhausted in a large amount.

A clutch is applied in a water pump so as to resolve the above problem, and the clutch is controlled according to engine RPM, coolant temperature, and an operation condition of a heater to selectively operate the water pump.

However, there is a drawback that the conventional variable water pump does not actively correspond to changing driving conditions and outside environmental factors.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable water pump control apparatus having advantages of actively controlling a variable water pump according to driving conditions and conditions outside of an engine.

In an aspect of the present invention, the variable water pump control apparatus, may include a detecting portion detecting engine speed, operation of an idle stop and go system (ISG), coolant temperature, operation of a blower, and outside temperature, a variable water pump selectively circulating a coolant through an engine, and a control portion controlling the variable water pump according to the detected information including operating conditions and outside environmental factors. In another aspect of the present invention, the variable water pump control method may include detecting a driving condition and an environmental condition of a vehicle, engaging or releasing a clutch of a variable water pump according to a detected condition so as to selectively circulate a coolant through an engine, and engaging the clutch of the variable water pump so as to forcibly circulate the coolant when it is determined that at least one sensor detecting the driving condition and the environmental condition of the vehicle senses errors.

As stated above, the variable water pump is actively controlled according to the driving conditions and the outside conditions such that the operating conditions and the cooling performance are optimized to enhance the durability of the engine.

Also, a time for activating the engine and the exhaust catalyst is reduced such that the fuel efficiency is improved and the exhaust gas quality is enhanced, and unnecessary power loss does not occur such that power of a battery is saved.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
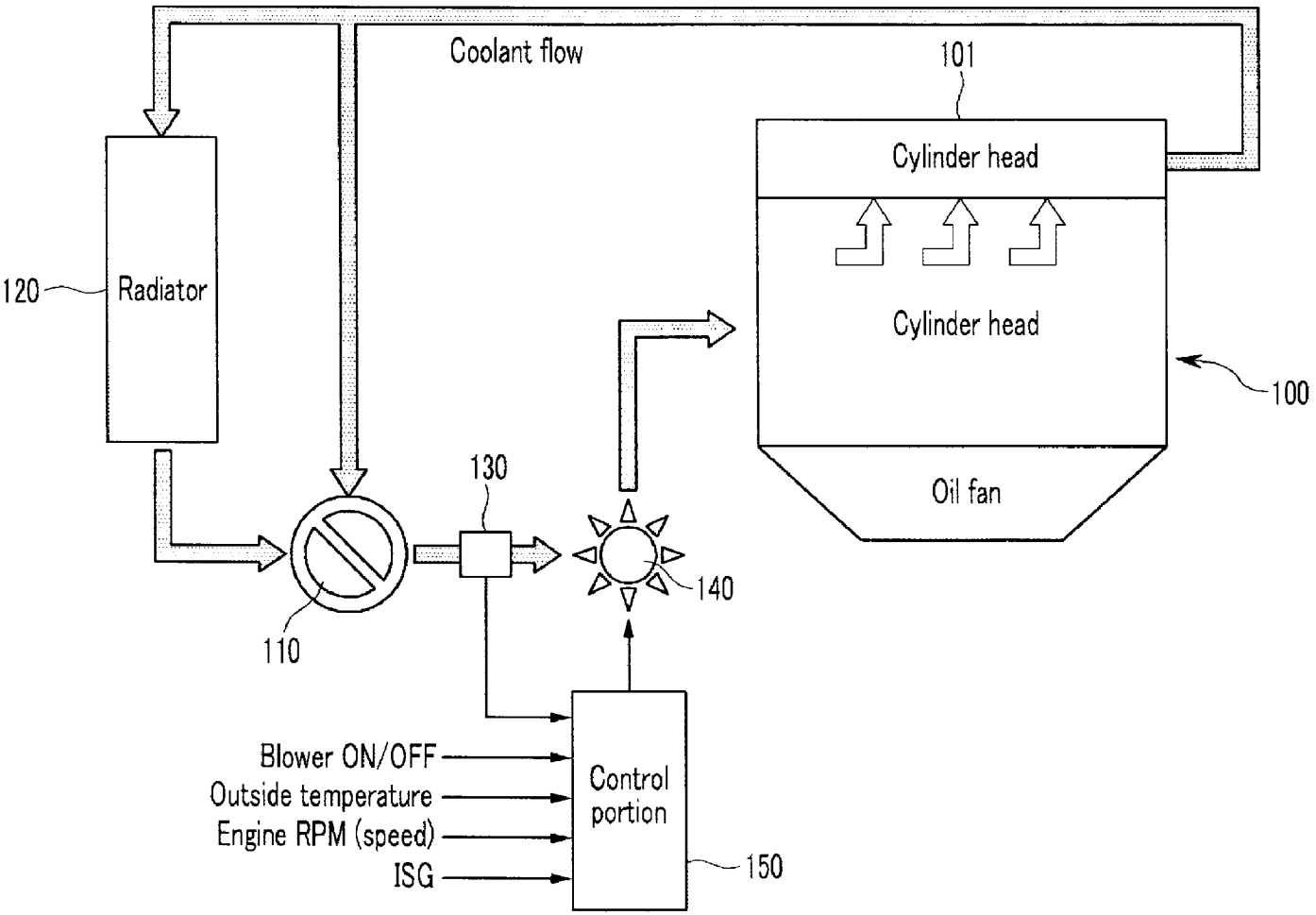
FIG. 1 is a schematic diagram showing a variable water pump control apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

FIG. 1 is a schematic diagram showing a variable water pump control apparatus according to an exemplary embodiment of the present invention.

The present invention includes an engine 100 as a power source, a thermostat 110 selectively circulating a coolant to a bypass line or a radiator 120, a radiator 120 radiating absorbed heat, a variable water pump 140 variably circulating the coolant through the engine 100, and a control portion 150 controlling operation of the water pump 140.

The variable water pump 140 can be selected from a clutch-type water pump and an electric-type water pump.

A coolant temperature sensor 130 is mounted inside the thermostat 110 to detect the temperature of the coolant, and the temperature signal detected by the coolant temperature sensor 130 is transferred to the control portion 150.

The variable water pump 140 is disposed between the engine 100 and the thermostat 110 to circulate the coolant according to control of the control portion 150.

The control portion 150 analyzes an on/off condition of a heater blower switch, the outside temperature, the engine speed, the coolant temperature detected by the coolant temperature sensor 130, and an operation condition of an idle stop and go system (ISG) to control the variable water pump 140.

The control portion 150 cuts power to connect an inside clutch of the variable water pump 140 so as to continuously circulate the coolant if at least one sensor detecting inside/outside driving conditions of the engine 100 senses errors.

Also, the control portion 150 connects the inside clutch of the variable water pump 140 to circulate the coolant regardless of the outside conditions and the coolant temperature if operation of the variable water pump 140 is demanded from a diagnosis device connected to a Hi-scan terminal as a trouble diagnosis connector prepared in a vehicle.

The control portion 150 circulates the coolant regardless of the coolant temperature if it is determined that the weather is very hot, that is, the outside temperature is higher than a predetermined value.

The control portion 150 circulates the coolant regardless of the coolant temperature if a blower switch for a heater of a vehicle interior is turned on.

The control portion 150 circulates the coolant if the blower for the heater of the vehicle interior is turned on and the outside temperature is less than a predetermined temperature, for example, 0° C.

An operating interval and operating time are adjusted according to engine speed, coolant temperature, and fuel consumption amount to be stored in a map table.

The control portion 150 cuts off the power to engage the interior clutch of the variable water pump 140 so as to circulate the coolant regardless of the coolant temperature in a condition that the idle condition of the vehicle lasts for a predetermined time.

The control portion 150 turns the variable water pump 140 on/off according to engine speed, for example, and if it is determined that the engine speed is higher than a predetermined value, the control portion 150 engages the clutch of the variable water pump 140 to circulate the coolant regardless of the coolant temperature.

Here, the on/off control of the variable water pump 140 according to the engine speed is based on hysteresis. The hysteresis loop is formed in a x-y graph in which a horizontal x line is input value, and a vertical y line is output value, wherein larger input value is necessary to offer a output value while the output value is climbing, and less input value is necessary to offer a output value while the output value is descending such that the output value is not fluctuated by the input value.

That is, in a condition in which the engine speed is very high, for example the clutch of the variable water pump is engaged or released at 5000-6000 RPM, the clutch durability can be deteriorated, and if the engine speed is higher than a predetermined value, preferably 3500 RPM, the interior clutch of the variable water pump 140 is engaged such that the clutch is not released or engaged at a very high engine speed.

The control portion 150 applies a low pass filter (attenuator) to an engine speed factor and a fuel consumption amount factor so as to stably adjust the clutch of the variable water pump 140, while the engine speed and the fuel consumption amount fluctuates unstably according to vehicle driving conditions.

If the engine is stopped by the ISG system, the control portion 150 engages the interior clutch of the variable water pump 140 such that electrical power that is consumed to release the interior clutch is saved to stably sustain a state of charge (SOC) of a battery (fuel cell).

In other words, electric power is supplied to release the clutch so as to stop the variable water pump 140, and if the engine 100 is stopped by the ISG system during the idle condition, the clutch is engaged so as to save electricity.

Also, in a case that the engine 150 is restarted in the idle stop condition, the control portion 150 applies a predetermined delay time so as to prevent an electrical impact according to engagement or release of the clutch, for example a predetermined time elapses after the engine 100 is restarted, and then the clutch of the variable water pump 140 is released.

In addition, while the clutch is engaged during the idle engine stop, the control portion 150 does not add up the engagement time of the clutch, and while the clutch is engaged during the normal operation of the engine, the control portion 150 adds up the engagement time of the clutch.

However, the clutch release time (period) is added up in a condition that the clutch of the variable water pump 140 is released regardless of the engine condition by the ISG system.

Figure 2:
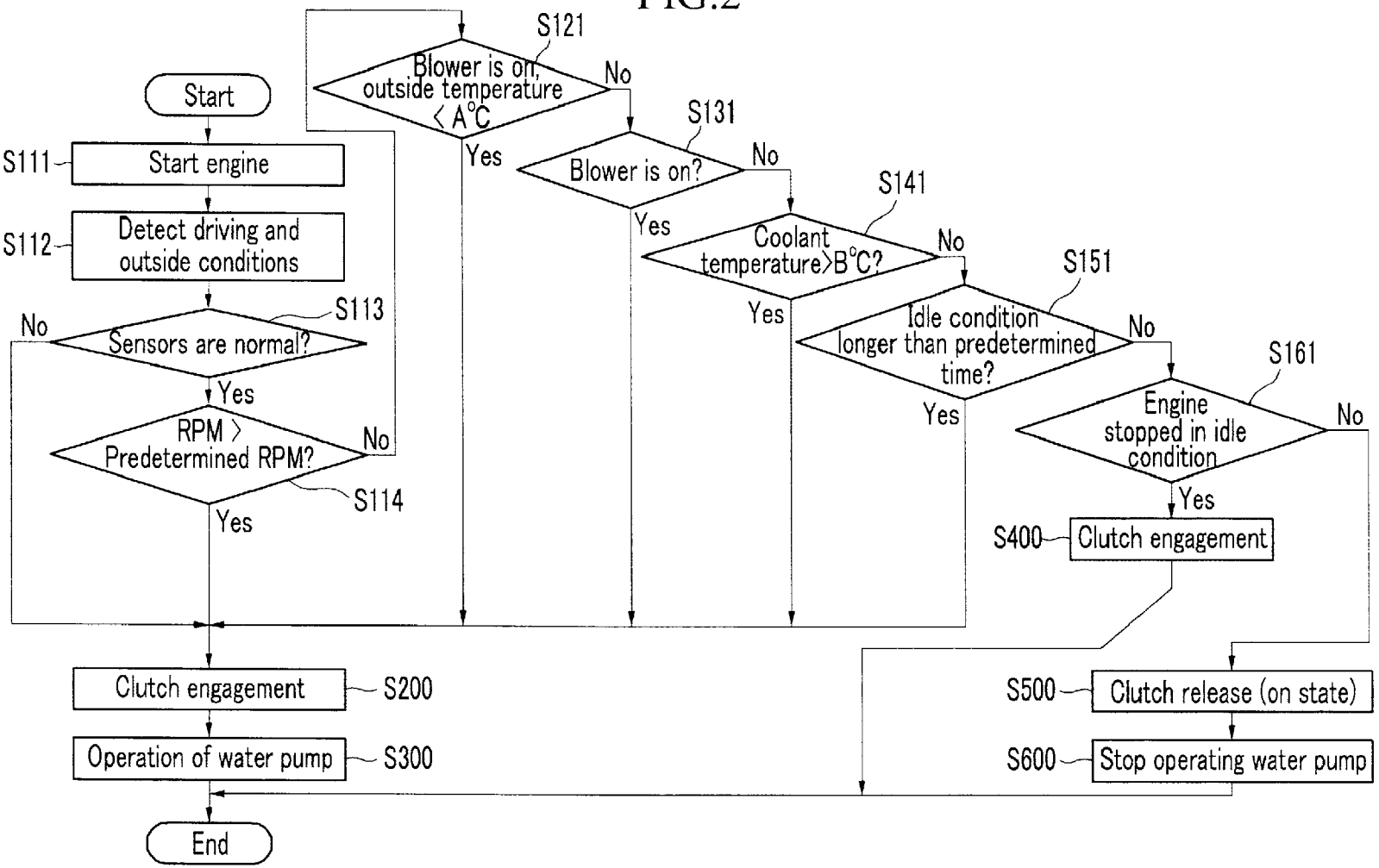
FIG. 2 is a flowchart showing a control procedure of a variable water pump according to an exemplary embodiment of the present invention.

Referring to FIG. 2, the present invention including functions as stated above will be explained as follows.

In a condition that the engine of the vehicle is operating (S111), the control portion 150 detects and analyzes driving information and environmental information such as cylinder head temperature from the temperature sensor 101, an on/off signal of a blower switch, outside temperature, engine speed, coolant temperature from the coolant temperature sensor 130, and operation of the ISG system (S112).

Subsequently, the control portion 150 determines whether all sensors detecting the inside and outside conditions of the engine 100 are normally operated or not (S113).

If it is determined that one of a plurality of sensors is defective in S113, the clutch of the variable water pump 140 is engaged (S200) to operate the water pump 140 so as to circulate the coolant (S300).

If it is determined that all sensors are normal in S113, it is determined whether the engine speed exceeds a predetermined value, for example, 3500 RPM (S114).

If it is determined that the engine speed is larger than a predetermined rotation speed, for example 3500 RPM, in S114, the control portion 150 engages the interior clutch of the variable water pump 140 (S200) regardless of the coolant temperature to operate the water pump 140 such that the coolant circulates (S300).

It is desirable for the predetermined rotation speed to be set to a medium-high range, for example 3500 RPM, because if the clutch of the variable water pump 140 is engaged at a high rotation speed, for example 5000-6000 RPM, the durability of the clutch can be deteriorated, and therefore the clutch of the variable water pump is engaged when the rotation speed is over 3500 RPM.

In this case, the on/off control of the variable water pump 140 is based on hysteresis While the engine speed and the fuel consumption amount fluctuate, the control portion 150 uses a low pass filter for an engine speed factor and a fuel consumption amount factor to control timing engagement and release of clutch of the variable water pump 140 such that the waiting time and the operation fluctuation of the clutch of the variable water pump 140 are decreased.

Also, if the blower (interior fan) for air conditioning and heating is on, and the outside temperature is less than a predetermined value, for example 0° C. (S 121), the control portion 150 engages the interior clutch of the variable water pump 140 so as to forcibly circulate the coolant regardless of the coolant temperature (S300).

Also, the control portion 150 determines whether a blower (air conditioning and heater fan) is on or not (S131), and if the blower is on, the clutch of the variable water pump 140 is engaged (S200) regardless of coolant temperature to operate the variable water pump 140 such that the coolant circulates (S300).

The control portion 150 detects the coolant temperature from the coolant temperature sensor 130, determines whether the coolant temperature exceeds a predetermined temperature, preferably 85° C. (S141), and if the coolant temperature is higher than the predetermined temperature, engages the clutch of the variable water pump 140 (S200) to operate the variable water pump 140 such that the coolant circulates (S300).

Also, the control portion 150 determines how long an idle condition of the engine 100 continues (S151), and if it is determined that the idle condition continues for longer than a predetermined period, it engages the clutch of the water pump 140 (S200) regardless of the coolant temperature such that the variable water pump 140 is operated to circulate the coolant (S300).

The control portion 150 determines whether the engine is stopped by the ISG system (S161), and if it is determined that the engine is stopped by the ISG system, the clutch is engaged to operate the variable water pump 140 (S200), in other words, the power that is necessary to sustain the release condition of the clutch is saved in an idle stop condition of the engine such that the SOC of a battery is sustained and the fuel consumption is reduced (S400).

In a condition that the clutch is released by supplying electric power so as to stop the variable water pump 140, if the engine 100 is stopped by the ISG system, the electric power is not supplied to engage the clutch such that the power is saved.

Also, in a condition in which the engine 100 is restarted from an engine stop condition by the ISG system, after a predetermined delay time from the starting time, the control portion 150 releases the clutch of the variable water pump 140 (S500) so as to prevent an electrical impact according to engagement or release of the clutch.

If the clutch of the variable water pump 140 is in an engaged condition when the engine is stopped by the ISG, the control portion 150 does not accumulate the clutch engagement time, and only accumulates the clutch engagement time while the engine 100 is normally operated.

However, in a condition in which the clutch of the variable water pump 140 is released to prevent the coolant from being circulated, the clutch release time is accumulated regardless of the ISG system.

Further, if a diagnosis device is connected to a Hi-scan terminal to make the variable water pump 140 operate, the control portion 150 engages the clutch regardless of the coolant temperature and the outside conditions of the vehicle to operate the variable water pump 140 such that the coolant circulates.

If the temperature of the engine measured by the temperature sensor 101 is larger than a predetermined temperature, for example 182° C., the control portion 150 determines that the engine 100 is warmed up, and engages the clutch of the variable water pump 140 to operate the variable water pump 140 such that the coolant circulates.

However, if it is determined that the engine is not warmed up, the clutch of the variable water pump 140 is released to stop the variable water pump 140 (S600).

Accordingly, the power loss caused by the water pump is minimized to enhance the efficiency of the fuel consumption.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable water pump control apparatus, comprising:

a detecting portion detecting engine speed, operation of an idle stop and go system (ISG), coolant temperature, operation of a blower, and outside temperature;

a variable water pump selectively circulating a coolant through an engine; and a control portion controlling the variable water pump according to the detected information including operating conditions and outside environmental factors;

wherein the control portion engages a clutch of the variable water pump so as to forcibly circulate the coolant regardless of a vehicle condition, when a diagnosis device connected to a Hi-scan terminal makes the variable water pump operate.

2. The variable water pump control apparatus of claim 1, wherein the control portion engages a clutch of the pump to circulate the coolant regardless of the coolant temperature, when at least one of the signals to be detected is not detected by the detecting portion, or it is determined that a part of the detecting portion is defective.

3. The variable water pump control apparatus of claim 1, wherein the control portion engages a clutch of the pump to circulate the coolant regardless of the coolant temperature, when the engine speed is higher than a predetermined rotation speed, a blower switch for a heater is turned on, the outside temperature is less than a predetermined temperature or higher than a predetermined temperature, a coolant temperature is larger than a predetermined value, a fuel is injected at more than a criterion, or the engine is stopped during an idle condition.

4. The variable water pump control apparatus of claim 1, wherein the control portion connects a clutch of the variable water pump so as to save electric power for sustaining disconnection of the clutch, when the engine is stopped in an idle condition.

5. The variable water pump control apparatus of claim 1, wherein the control portion releases a clutch of the variable water pump after a predetermined delay time so as to prevent an electric impact according to engagement and release of the clutch, in a condition in which the engine is stopped in an idle condition by the ISG system.

6. The variable water pump control apparatus of claim 1, wherein the control portion does not accumulate a clutch engagement time of the variable water pump, while the engine is stopped by the ISG system, and only accumulates the clutch engagement time while the engine is operating.

7. The variable water pump control apparatus of claim 1, wherein the control portion accumulates a clutch release time regardless of an engine stop condition caused by the ISG system.

8. The variable water pump control apparatus of claim 1, wherein the control portion applies a low pass filter to an engine speed factor and a fuel consumption amount factor so as to prevent a standby time or a fluctuation width of a clutch from being increased.

9. The variable water pump control apparatus of claim 1, wherein the control portion stores map data having an operating interval and an operating time of the variable water pump according to the coolant temperature, an engine speed, and a fuel consumption amount.

10. The variable water pump control apparatus of claim 1, wherein the control portion engages or releases a clutch of the variable water pump according to the outside temperature and the coolant temperature.

11. The variable water pump control apparatus of claim 1, wherein the control portion engages a clutch of the variable water pump regardless of the coolant temperature, when the engine speed exceeds a predetermined value.

12. The variable water pump control apparatus of claim 1, wherein the control portion engages a clutch of the variable water pump so as to circulate the coolant regardless of the coolant temperature, when the blower for a heater is being operated.

13. The variable water pump control apparatus of claim 1, wherein the control portion adjusts an operation cycle of a clutch of the variable water pump.

14. A variable water pump control apparatus, comprising:

a detecting portion detecting engine speed, operation of an idle stop and go system (ISG), coolant temperature, operation of a blower, and outside temperature;

a variable water pump selectively circulating a coolant through an engine; and a control portion controlling the variable water pump according to the detected information including operating conditions and outside environmental factors;

wherein the control portion engages or releases a clutch of the variable water pump with hysteresis according to the engine speed.

15. A variable water pump control method, comprising:

detecting a driving condition and an environmental condition of a vehicle;

engaging or releasing a clutch of a variable water pump according to a detected condition so as to selectively circulate a coolant through an engine; and engaging the clutch of the variable water pump so as to forcibly circulate the coolant when it is determined that at least one sensor detecting the driving condition and the environmental condition of the vehicle senses errors;

wherein the clutch of the variable water pump is engaged or released according to an engine speed with hysteresis.

16. The variable water pump control apparatus of claim 15, wherein the clutch of the variable water pump is engaged to circulate the coolant regardless of the environmental condition, when an operating signal of a diagnosis device connected to a Hi-scan terminal demand is transferred.

17. The variable water pump control apparatus of claim 15, wherein the clutch of the variable water pump is engaged so as to circulate the coolant regardless of a coolant temperature, when an outside temperature of the environmental condition is higher than a predetermined temperature.

18. The variable water pump control apparatus of claim 15, wherein the clutch of the variable water pump is engaged so as to circulate the coolant regardless of a coolant temperature, when a blower for a heater is being operated.

19. The variable water pump control apparatus of claim 15, wherein the clutch of the variable water pump is engaged so as to circulate the coolant regardless of a coolant temperature, when an engine of the vehicle is being operated in an idle condition longer than a predetermined time.

20. The variable water pump control apparatus of claim 15, wherein the clutch of the variable water pump is engaged so as to sustain a state of charge (SOC) of a battery, when an engine is stopped by an ISG system in an idle condition of the engine.

21. The variable water pump control method of claim 20, wherein a clutch of the variable water pump is released after a predetermined delay time from a point when the engine is restarted from an idle stop condition by the ISG system.

22. The variable water pump control method of claim 20, wherein an engaged time of the clutch is not accumulated when the engine is stopped by the ISG system, and the engaged time of the clutch is accumulated when the engine is being normally operated.

23. The variable water pump control apparatus of claim 15, wherein a low pass filter is used to control the clutch of the variable water pump such that a delay time and a fluctuation width for engaging or releasing the clutch are reduced.

24. The variable water pump control apparatus of claim 15, wherein an operation interval and an operating time of the variable water pump are stored in a map table according to coolant temperature, engine speed, and fuel consumption amount.

25. The variable water pump control apparatus of claim 15, wherein the variable water pump is turned on/off according to outside temperature and coolant temperature.

26. The variable water pump control apparatus of claim 15, wherein the variable water pump is turned on/off according to engine speed with hysteresis.

27. The variable water pump control apparatus of claim 15, wherein the variable water pump forcibly circulates the coolant regardless of coolant temperature, when an engine speed is higher than a predetermined value.

28. The variable water pump control apparatus of claim 15, wherein the variable water pump circulates the coolant regardless of coolant temperature, when a blower for a heater is turned on and an outside temperature is less than a predetermined value.

* * * * *